US006547365B1

(12) United States Patent
Alberto et al.

(10) Patent No.: US 6,547,365 B1
(45) Date of Patent: Apr. 15, 2003

(54) PRINTHEAD END OF LIFE DETECTION SYSTEM

(75) Inventors: Joaquin Alberto, Barcelona (ES); Marcelo Ymbern, Barcelona (ES); Lidia Calvo, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/997,388

(22) Filed: Oct. 31, 2001

(51) Int. Cl.[7] ..... B41J 29/393
(52) U.S. Cl. ..... 347/19
(58) Field of Search ..... 347/14, 19, 23, 347/12, 10, 20, 30, 33, 60, 7, 43, 85–87; 358/296; 400/74

(56) References Cited

U.S. PATENT DOCUMENTS

| | | | | |
|---|---|---|---|---|
| 4,791,435 A | | 12/1988 | Smith et al. | |
| 4,853,717 A | | 8/1989 | Harmon et al. | |
| 4,907,013 A | | 3/1990 | Hubbard et al. | |
| 4,926,196 A | | 5/1990 | Mizoguchi et al. | |
| 4,977,459 A | | 12/1990 | Ebinuma et al. | |
| 5,103,244 A | | 4/1992 | Gast et al. | |
| 5,124,720 A | | 6/1992 | Schantz | |
| 5,164,748 A | | 11/1992 | Katayanagi et al. | |
| 5,455,608 A | | 10/1995 | Stewart et al. | |
| 5,610,635 A | | 3/1997 | Murray et al. | |
| 5,627,571 A | | 5/1997 | Anderson et al. | |
| 5,798,773 A | * | 8/1998 | Hiramatsu et al. | 347/19 |
| 6,099,101 A | | 8/2000 | Maurelli et al. | |
| 6,106,088 A | | 8/2000 | Wafler | |
| 6,145,981 A | | 11/2000 | Akahira et al. | |
| 6,328,112 B1 | | 5/2001 | Girones et al. | |

FOREIGN PATENT DOCUMENTS

| | | | | |
|---|---|---|---|---|
| EP | 0783973 | | 7/1997 | |
| EP | 0 863 004 A2 | * | 3/1998 | 347/19 |
| EP | 0863004 | | 9/1998 | |
| JP | 63221050 | | 9/1988 | |
| JP | 63224956 | | 9/1988 | |
| JP | 04269549 | | 9/1992 | |

* cited by examiner

*Primary Examiner*—Hai Pham
*Assistant Examiner*—Charles W. Stewart, Jr.

(57) ABSTRACT

A method and apparatus for printing a print job includes determining which nozzles of a printhead are currently failing, estimating a number of additional printhead nozzles that will fail while printing the print job, calculating a maximum number of failing nozzles that may not be exceeded in order to maintain a specified quality level for the print job, and determining if the number of currently failing printhead nozzles added to the estimated number of additional printhead nozzles that will fail exceeds the calculated maximum number of failing nozzles. The method and apparatus also includes providing a notification in the event that the number of currently failing printhead nozzles added to the estimated number of additional printhead nozzles that will fail exceeds the calculated maximum number of failing nozzles.

18 Claims, 7 Drawing Sheets

PRINTHEAD END OF LIFE DETECTION SYSTEM

FIELD OF THE INVENTION

The present invention relates to printing devices, and, in particular, to a method and apparatus for predicting the end of life of a printhead.

BACKGROUND OF THE INVENTION

Inkjet printing mechanisms may be used in a variety of different printing devices, such as plotters, facsimile machines and inkjet printers, collectively referred to herein as printers. These printing mechanisms typically use a printhead to shoot drops of ink onto a page or sheet of print media. Some inkjet print mechanisms utilize a type of printhead called a cartridge that carries a self contained ink supply back and forth across the media. In the case of a multi-color cartridge, several printheads and reservoirs may be combined into a single unit, which may also be referred to as a printhead.

Other inkjet print mechanisms, known as "off-axis" systems, propel only a small amount of ink in the printhead across the media, and include a main ink supply in a separate reservoir, which is located "off-axis" from the path of printhead travel. Typically, a flexible conduit or tubing is used to convey the ink from the reservoir to the printhead. A printhead may also have a cap or capping mechanism such that when the printhead is not printing, the printhead is covered. This may serve to prevent the printhead from drying and/or to otherwise protect the printhead from the environment.

Each printhead includes very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett Packard Company. In a thermal ejection system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To print an image, the printhead is scanned back and forth across above the media in an area known as a print zone, with the printhead shooting drops of ink as it moves. By selectively energizing the resistors as the printhead moves across the media, the ink is expelled in a pattern on the media to form a desired image (e.g., picture, chart or text). The nozzles are typically arranged in one or more linear arrays. If more than one linear array is utilized, the linear arrays may be located side-by-side on the printhead, parallel to one another, and substantially perpendicular to the scanning direction. As such, the length of the nozzle arrays defines a print swath or band. That is, if all the nozzles of one array were continually fired as the printhead made one complete traverse through the print zone, a band or swath of ink would appear on the sheet. The height of this band is known as the "swath height" of the printhead, the maximum pattern of ink which can be laid down in a single pass.

The orifice plate of the printhead tends to accumulate contaminants, such as paper dust, and the like, during the printing process. Such contaminants may adhere to the orifice plate for various reasons including the presence of ink on the printhead, or because of electrostatic charges that may build up during operation. In addition, excess dried ink may accumulate around the printhead. The accumulation of ink or other contaminants may impair the quality of the output by interfering with the proper application of ink to the printing medium. Also, if color printheads are used, each printhead may have different nozzles which each expel different colors. If ink accumulates on the orifice plate, a mixing of different colored inks, known as cross-contamination, can result during use. If colors are mixed on the orifice plate, the quality of the resulting printed product can be affected. Furthermore, the nozzles of an ink-jet printer can clog, particularly if the printheads are left uncapped for a period of time. For these reasons, it is desirable to service the printhead by clearing the printhead orifice plate of such contaminants and ink on a routine basis to prevent the build up thereof. This may be accomplished by a service procedure where a printhead expels ink, is brought in contact with a wiper and expels ink again, also called a spit, wipe spit procedure. In some printers this service procedure is performed at the end of a print job based on certain criteria, for example, the number of drops fired since the last spit, wipe, spit procedure, the time a printhead has been uncapped, upon a user request, when power has first been applied to the printer, etc. Service procedures such as the spit, wipe, spit procedure are desirable to maintain print quality but also contribute to increased throughput time because of the time required to perform the procedure. These types of procedures also contribute to a shorter printhead life because the wiping action may degrade the nozzle plate over time by scratching and distorting its surface.

U.S. Pat. No. 5,455,608 describes how a printer may schedule service on a printhead based on the result of a drop detection step. Before starting a plot the printer performs a drop detection on all printheads present to detect if any nozzles are non-firing, also referred to as a "nozzle out" condition. If a nozzle out condition is detected in a printhead, the printer triggers an automatic recovery servicing process for servicing the malfunctioning printhead to clear or otherwise recover the malfunctioning nozzle.

This process includes a sequence of nozzle recovery or clearing procedures of increasing severity. At the end of each procedure a new drop detection test is performed on the printhead, to detect if the printhead is fully recovered. If the drop detection test indicates that a nozzle out condition continues to exist, another servicing procedure is performed. If, after a predetermined number of procedures, the printhead is still not fully recovered (i.e. at least one nozzle is still out) the user is instructed to replace the printhead or to discontinue the current nozzle check. Thus, a "nozzle health" detection is performed before each print job and recovery procedures are performed based on a fixed threshold, in this example, at least one nozzle remaining non-firing.

If the printer is not able to fully recover the failing nozzles or if some nozzles are intermittent, the system may attempt to use error hiding techniques to compensate for these failures. However, there is a maximum number of failing nozzles for which the system will not be able to compensate. If the system is unable to compensate for the failing or intermittent nozzles, the system may run the recovery servicing process at the beginning of each print job, whenever the nozzle health indicates that a servicing process is required, or in response to a user request. This may continue until the printhead has been fully recovered or replaced. This may lead to an unacceptable loss of throughput and a loss of printer productivity because the automatic recovery process is very time consuming, and consumes a large quantity of ink, particularly if a priming function is included in the recovery process. In some instances, before each plot the printer may direct the user to replace the printhead or to discontinue the current nozzle check.

It is possible for a nozzle to fail during printing. If this happens, the maximum number of nozzles out, for which the system is unable to compensate, may be exceeded. This could result in less than desirable overall image quality. The probability of a nozzle failing during a print job is made more likely by certain trends. There is a trend toward wider printing areas, and thus wider plotters, to accommodate wider media. At the present time plotters accommodating sixty inch wide media are commonly available. In addition to larger printing widths, the length of print jobs continues to increase. The number of ink compositions available for use is also proliferating in order to provide the number of colors and quality desired by users. Correspondingly, the number of printheads present in a plotter to deliver these inks is also increasing. As the number of printheads increases, the number of ink reservoirs is also increasing, with a trend toward having one reservoir per printhead for increased ink capacity. An additional trend is an increase in job density, that is, the complexity of plots requested by users.

It would be advantageous to alert a user about the probability of finishing a print job within a given set of quality criteria, preferably before the print job begins. It would also be advantageous to alert a user before starting a job in the event that there is a low probability of meeting the minimum quality requirements for a print job, allowing the user either to ignore the alert, or to take action to correct the problem. In this way, time, media, ink, etc. are less likely to be wasted.

SUMMARY OF THE INVENTION

The invention provides for a method and apparatus for printing a print job including determining which nozzles of a printhead are currently failing, estimating a number of additional printhead nozzles that will fail while printing the print job, calculating a maximum number of failing nozzles that may not be exceeded in order to maintain a specified quality level for the print job, and determining if the number of currently failing printhead nozzles added to the estimated number of additional printhead nozzles that will fail exceeds the calculated maximum number of failing nozzles. The invention also includes providing a notification in the event that the number of currently failing printhead nozzles added to the estimated number of additional printhead nozzles that will fail exceeds the calculated maximum number of failing nozzles.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
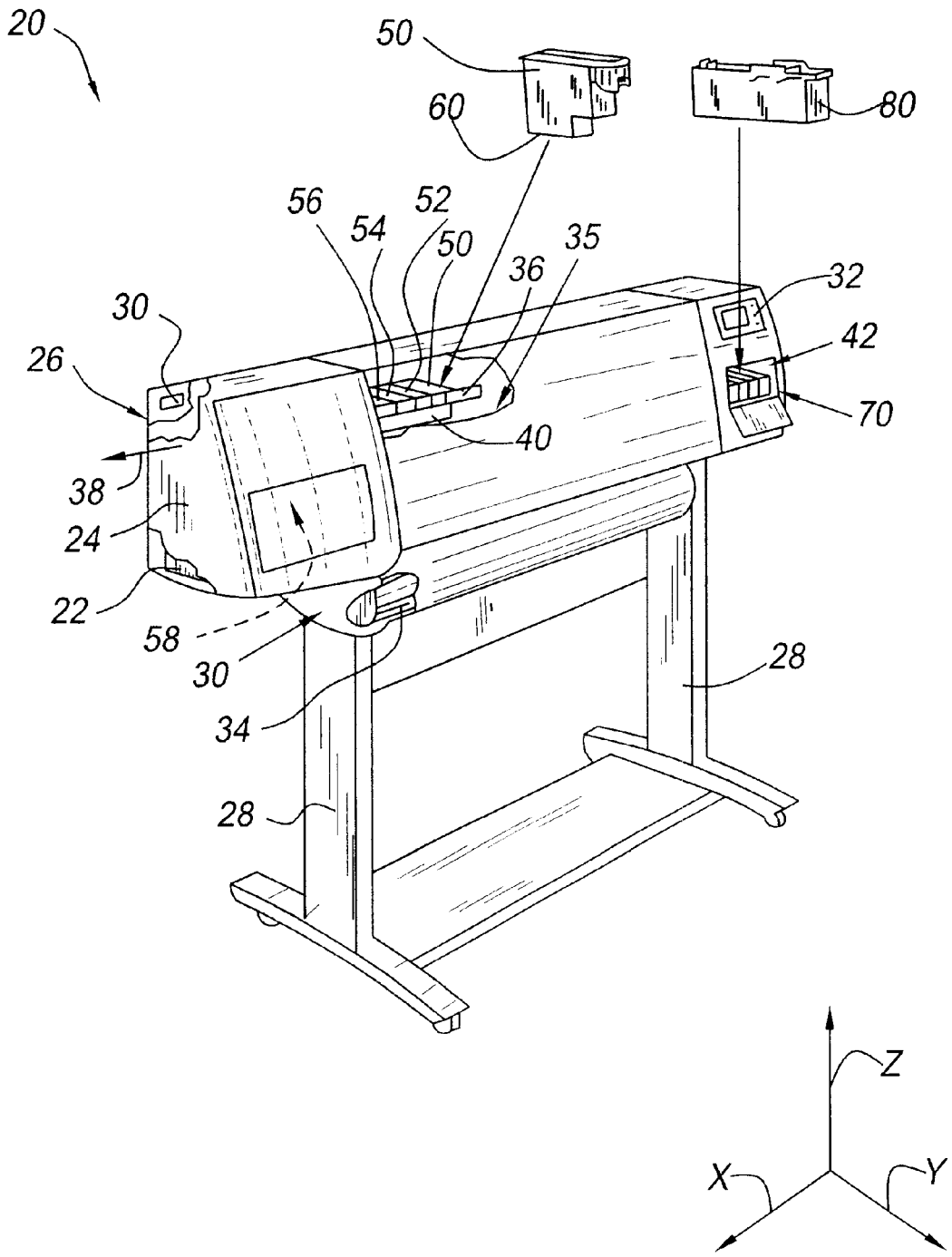
FIG. 1 is a perspective view of a printer in accordance with the invention in cut-away form.

FIG. 1 shows an example of a large format inkjet printer 20, also called a plotter. Plotters are usually used for printing conventional engineering and architectural drawings as well as high quality poster-sized images, and the like, in an industrial, office, home, or other environment.

Inkjet printing mechanisms are commercially available in many different types of products. For instance, some of the commercially available products that may embody the present invention include desk top printers, portable printing units, copiers, cameras, video printers, facsimile machines, etc.

The printer 20 in this example includes a chassis 22 surrounded by an enclosure 24, forming a printer assembly 26. The printer assembly 26 may be supported on a desk or tabletop, but is preferably supported by a pair of leg assemblies 28. The printer 20 also has a controller, illustrated schematically as a processor 30, that receives instructions from a host device, typically a computing device, for example, a personal computer, a mainframe, etc.

The printer 20 may also include a key pad and display panel 32, which provides a user interface where the display provides information to a user and the keypad accepts input from the user. A monitor (not shown) coupled to the host device may also be used to display visual information to an operator, such as printer status, service requirements, error conditions, etc.

A conventional print media handling system (not shown) may be used to advance a continuous sheet of print media 34 through a print zone 35. The print media may be any type of suitable sheet material, such as paper, poster board, fabric, transparencies, mylar, etc. A carriage guide rod 36 is mounted to the chassis 22 to define a scanning axis 38, with the guide rod 36 slideably supporting a printhead carriage 40 for travel back and forth, reciprocally, across the print zone 35. A conventional carriage drive motor (not shown) may be used to propel the carriage 40 in response to a control signal received from the controller 30. To provide carriage position information to controller 30, a conventional metallic encoder strip (not shown) may be extended along the length of the print zone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information may also be accomplished in a variety of other ways. Upon completion of a print job, the carriage 40 may be used to drag a cutting mechanism across the final trailing portion of the media to sever the printed portion of the media from the remainder of the continuous sheet 34. Moreover, the printer 20 may also be capable of printing on pre-cut sheets, rather than on continuous sheet media 34.

Figure 2:
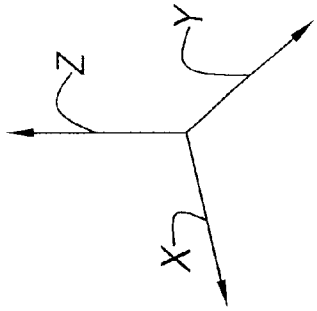
FIG. 2 is a perspective view of a printhead service station.
Figure 2:
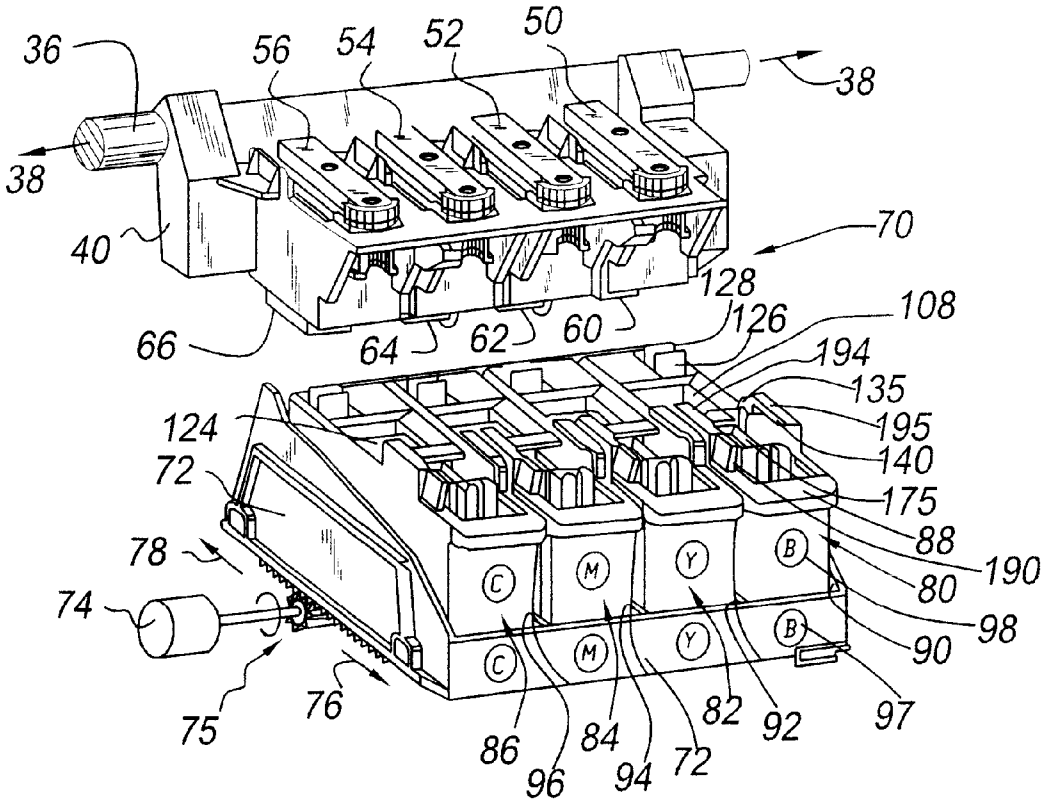

In the print zone 35, the media 34 receives ink from at least one printhead, for example, a black ink printhead 50 and three monochrome color ink printheads 52, 54 and 56, as shown in FIG. 2.

The black ink printhead 50 is illustrated herein as containing a pigment based ink while the color printheads 52, 54 and 56 are each described as containing a dye based ink of the colors yellow, magenta and cyan, respectively. It should be understood that the color printheads 52, 54, 56 may also contain pigment based inks and that other types of inks may be used in the printheads 50, 52, 54, 56 such as paraffin based inks, hybrid inks having both dye and pigment characteristics, and any other type of ink suitable for plotting applications. In a this example the printer 20 uses an "off axis" ink delivery system, having main reservoirs (not shown) for each ink (black, cyan, magenta, yellow) located in an ink supply section 58. In this off axis system, the printheads 50, 52, 54, 56 may be replenished by ink conveyed through a conventional flexible tubing system (not shown) from the stationary main reservoirs, so only a small ink supply is propelled by the carriage 40 across the print zone 35 which is located "off axis" from the path of printhead travel.

Figure 3:
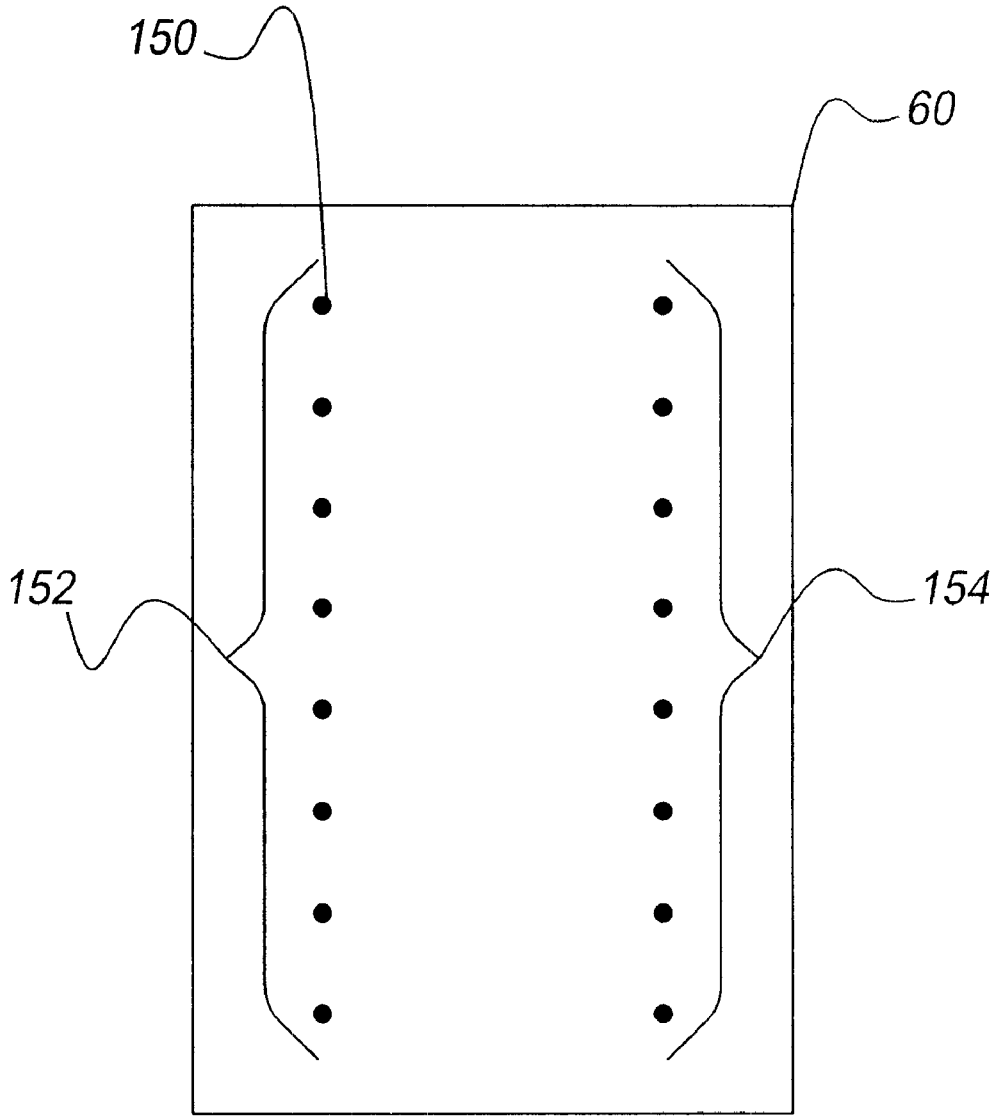
FIG. 3 is a diagram of a printhead showing the placement of nozzles on an orifice plate.

The printheads 50, 52, 54, 56 each have an orifice plate 60, 62, 64, 66, respectively. As shown in FIG. 3, each orifice plate 60, 62, 64, 66 includes a plurality of nozzles 150. The nozzles 150 of each orifice plate 60, 62, 64, 66 are typically formed in at least one, but typically two linear arrays 152, 154 along the orifice plate. Each linear array is typically aligned in a longitudinal direction substantially perpendicular to the scanning axis 38, with the length of each array determining the maximum image swath for a single pass of a printhead.

FIG. 2 shows the carriage 40 positioned with the printheads 50, 52, 54, 56 ready to be serviced by a replaceable printhead cleaner service station 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes a number of print head cleaner units corresponding to the number of printheads. In this example, the service station 70 includes four replaceable printhead cleaner units 80, 82, 84, 86 for servicing the respective printheads 50, 52, 54, 56.

Each printhead cleaner unit 80, 82, 84, 86 also includes a spittoon chamber 108. The spittoon 108 may be filled with an ink absorber 124, preferably of a foam material, although any suitable absorbing material may be used. The absorber 124 receives ink spit from the printheads 60, 62, 64, 66 and holds the ink while the volatiles or liquid components evaporate, leaving the solid components of the ink trapped within the chambers of the foam material. In one embodiment, the spittoon 108 of the black printhead cleaner unit 80 is supplied as an empty chamber, which then fills with a tar like black ink residue over the life of the cleaner unit.

Each printhead cleaner unit 80, 82, 84, 86 may include a dual bladed wiper assembly which has two wiper blades 126 and 128, which are preferably constructed with rounded exterior wiping edges, and an angular interior wiping edge.

The black printhead cleaner unit 80, used to service black printhead 50, which may include a pigment based ink, may also include an ink solvent chamber (not shown) which holds an ink solvent. To deliver the solvent from the reservoir to the orifice plate 60, the black cleaner unit 80 preferably includes a solvent applicator or member 135, which underlies the reservoir block.

Figure 4:
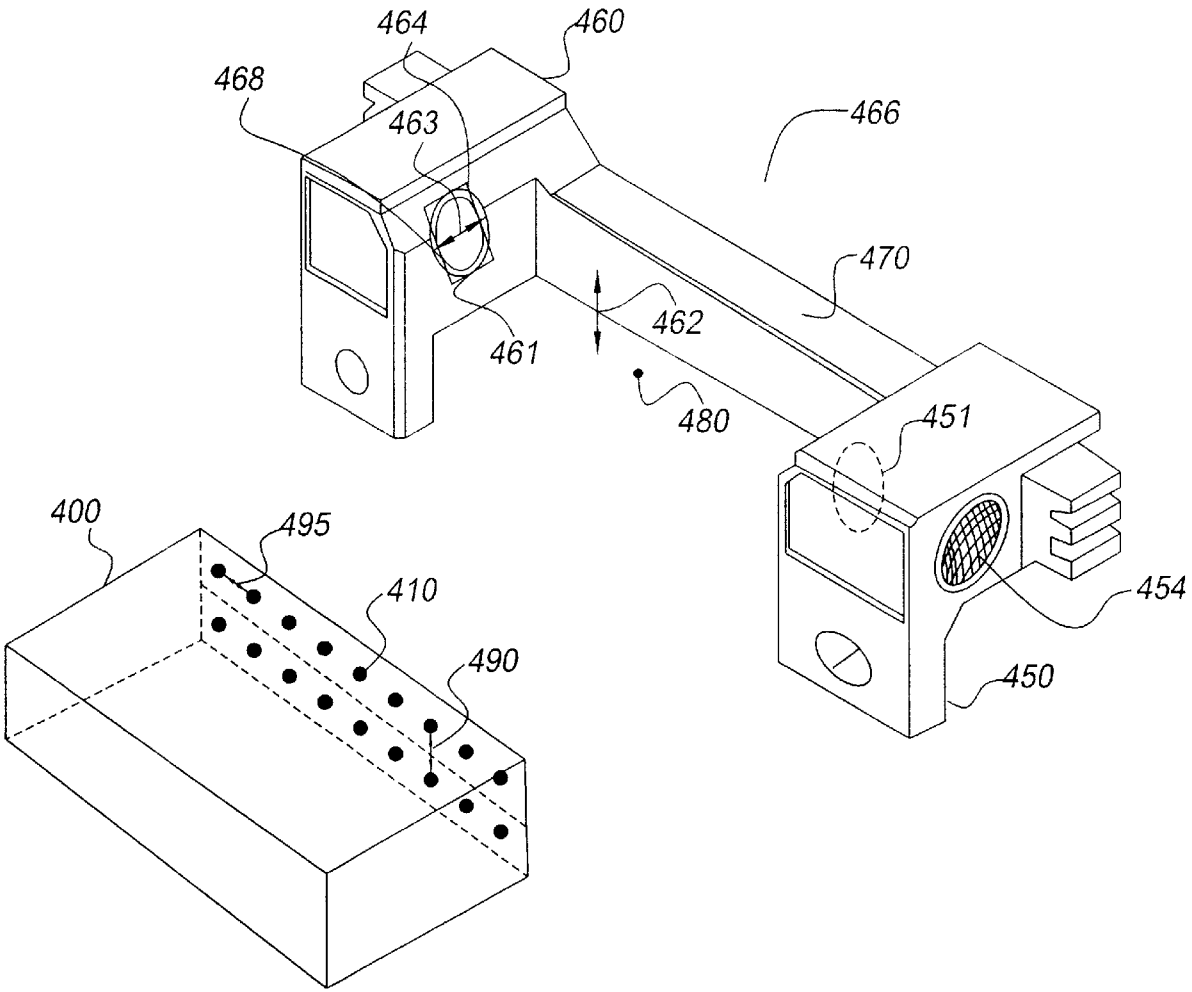
FIG. 4 illustrates a drop detection device.

FIG. 4 shows a schematic representation of a printhead and a drop detection device. A printhead 400, which may include any one of printheads 60, 62, 64, 66 comprises an array of printer nozzles 410. Preferably, the printhead 400 includes of two rows of printer nozzles 410, with each row having 524 printer nozzles.

The printhead 400 is configured to spray or eject a single droplet or a sequence of droplets of ink 480 from the nozzle 410 in response to commands issued by the controller 30. An emitter 464 is mounted in an emitter housing 460 and a detector 454 is mounted in a detector housing 450. An elongate, substantially straight, rigid member 470 connects the two housings 450, 460. The emitter housing 460, member 470 and detector housing 450 all comprise a substantially rigid assembly 466 configured to actively locate the emitter 464 with respect to the detector 454.

The printhead 400, rigid assembly 466, emitter 464, and detector 454 are orientated with respect to each other such that a path traced by the ink droplet 480 passes between the emitter 464 and the detector 454.

A collimator 468 is provided either as part of the emitter 464 or as a separate item so as to collimate radiation emitted by the emitter 464 into a radiation beam which exits the emitter housing 460 via aperture 461. The collimated radiation beam is admitted into detector housing 450 by way of aperture 451 and impinges on detector 454. The ink droplet 480 sprayed from nozzle 410 enters the collimated radiation beam and causes a change in the beam impinging on detector 454.

Various techniques may be employed to detect ink droplets using the drop detection device 466. These may include, for example, spraying a specific number of ink drops from individual nozzles in turn in specific timing sequences to account for the speed of the drops, accounting for the distance between the nozzle and the radiation beam, determining the time the drop spends in the radiation beam etc.

The ink drop detector may also be a "print on media and scan" type drop detector or nozzle health detector where a pattern is printed on the media and then scanned to determine nozzle functionality.

It is important to note that the ink drop detection device is at least able to determine parameters related to the health of each nozzle. Some examples may include parameters related to whether a nozzle is fully functional or not ejecting ink at all (a "nozzle out" condition).

Figure 5:
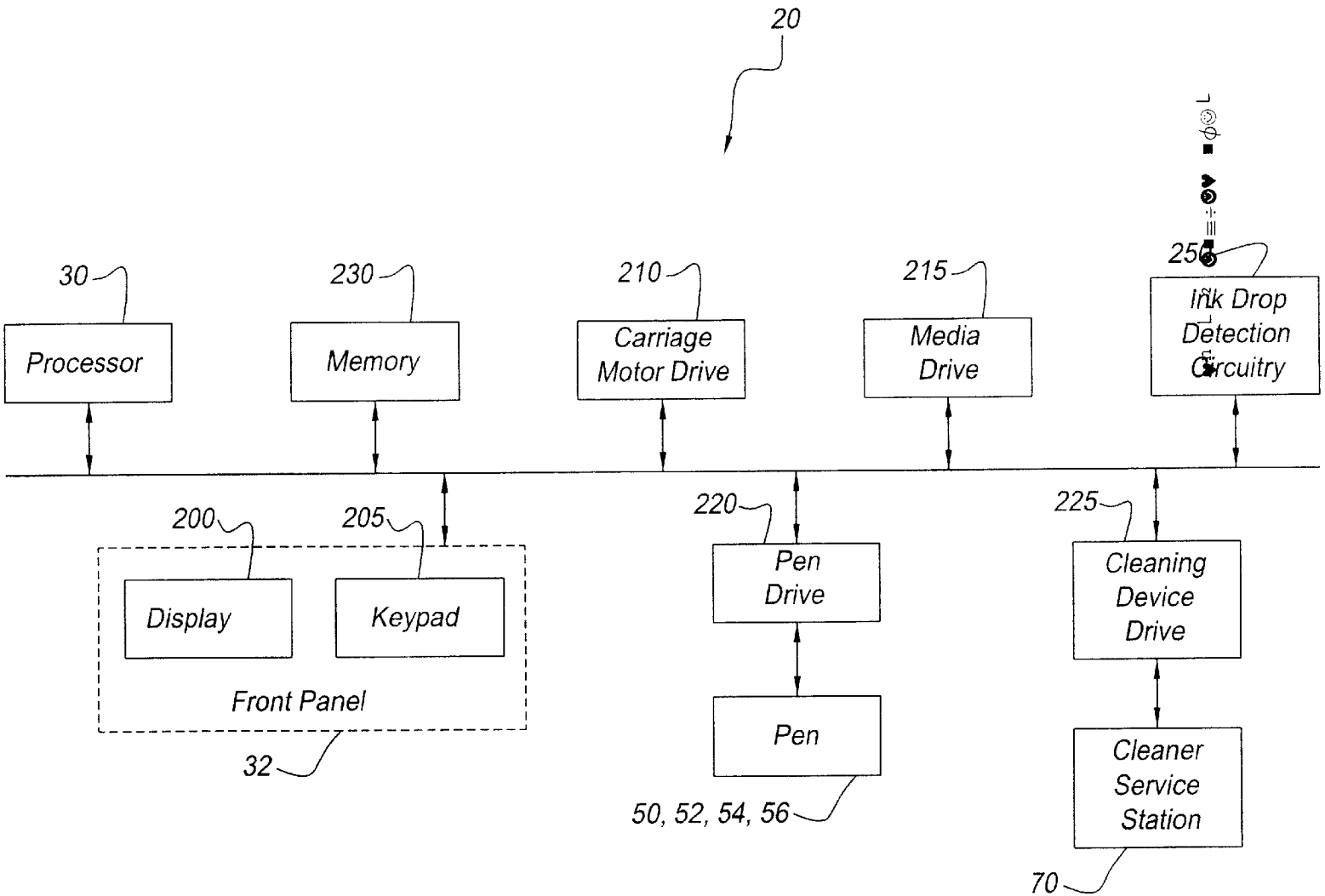
FIG. 5 illustrates schematically a block diagram of the printer.

FIG. 5 shows a block diagram of printer 20. Printer 20 includes the processor 30 for directing printer operations and front panel 32 including a display 200 and keypad 205 for displaying messages to a user and receiving user inputs, respectively. The printer 20 also includes a carriage motor drive 210 for positioning the carriage 40, a media drive 215 that operates to position the media 34, and printhead drive circuitry 220 for controlling the individual nozzles on each printhead 50, 52, 54, 56. Printer 20 also includes a cleaning device drive 225 for positioning the printhead cleaner service station 70, and memory 230 for storing programs, including a printer operating system, temporary system operating parameters and temporary data.

The processor 30 executes the programs in memory 230 either automatically, in response to user inputs from front panel 32, or in response to inputs from the host device. The programs executed by the processor 30 may include routines for checking the status of various printer components at power up, receiving print jobs, displaying information and receiving commands from a user, and performing various maintenance and recovery actions. For example, in the event that the ink drop detection systems detects that a certain nozzle is in a "nozzle out" condition, a program may be executed that causes the nozzle that is out and printhead cleaning device 70 to operate together to clear the condition. An example procedure may include operating the nozzle to expel ink, operating the printhead cleaning device to wipe the nozzle and operating the nozzle to expel ink again, as in the spit, wipe, spit procedure described above.

The printer 20 also includes ink drop detection circuitry 250 to operate and receive information from the ink drop detector 466. The ink drop detection circuitry 250 may also be configured to store history information about a particular nozzle in memory 230. This may include an indication of whether or not a nozzle is presently fully functional or is in a "nozzle out" condition, information related to the types of previous failures, the time between failures, the number and type of recovery actions, and any other information regarding the nozzles that may be suitably stored.

The programs executed by the processor 30 preferably include routines for analyzing the quality requirements of incoming print jobs and for calculating the probability that, for each printhead to be utilized, the minimum number of nozzles required to maintain the quality requirements for the job will be available during the print job. In other words, the probability that the maximum number of nozzles out will not be exceeded during the particular print job may be calculated by the processor 30.

If a printhead experiences a series of nozzle failures, these failures will typically be distributed over a number of nozzles. Nozzle failures are due to various factors, including printhead lot and/or age, printer age, environmental conditions, number of droplets ejected, type of ink, etc. For purposes of this invention, these factors are assumed to contribute randomly to nozzle failure. In addition, nozzle failures have some dependency upon each other. As one example, residue build up on the nozzle plate may affect a number of nozzles at the same time. Therefore, for purposes of the teachings herein, the nozzle failures are assumed to occur randomly and to have some dependence upon one another.

In order to ensure that the probability of reaching the maximum number of nozzles out in an unpredictable way is minimized, the total ink flux for the particular print job can be utilized with a prediction model. Total ink flux may be defined as an average ink volume distributed over an area of media. Ink flux may typically be measured as $cc/m^2$ (cubic centimeters over square meters). Ink flux is an important factor for determining nozzle failures because the expected mean life of a printhead is typically measured as the total volume of ink in cubic centimeters expelled by the printhead.

Figure 6:
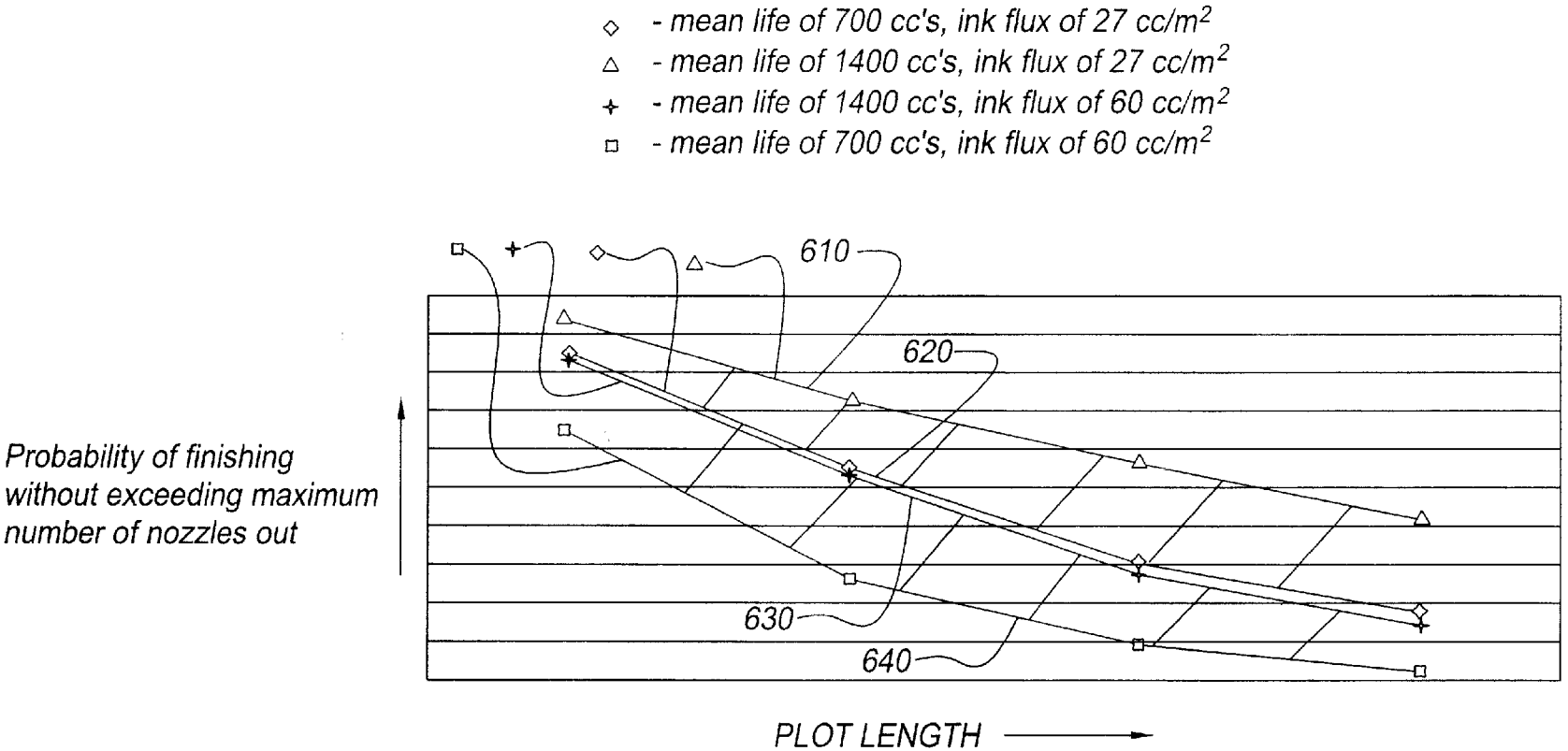
FIG. 6 shows the probability of finishing a print job using a number of printheads with different life times and for various ink fluxes.

FIG. 6 shows example data of the relative probability of finishing a print job with respect to plot length. FIG. 6 shows generally that the probability of finishing a print job without exceeding the maximum number of nozzles out decreases as the plot length increases. In particular, for an incoming print job having an ink flux of 27 $cc/m^2$, line 610 shows the relative probability of finishing the print job when utilizing a printhead with an expected mean life of 1400 cc's. Line 620 shows the relative probability of finishing a print job having the same ink flux when utilizing a printhead with an expected mean life of 700 cc's. Lines 630 and 640 show the relative probability of finishing a print job with an ink flux of 60 $cc/m^2$ for printheads with expected mean lives of 1400 and 700 cc's respectively. Thus, it can also be seen that generally, the probability of completing a print job decreases as the ink flux increases.

A printhead may be considered as a combination of repairable and non-repairable systems because recovery procedures and masking techniques may "repair" some nozzle problems while some failure mechanisms are incapable of being recovered. The nozzle out process may be modeled assuming that each nozzle out represents a failure of a printhead system.

Table 1 shows example data of the distribution of the number of nozzle outs over time for a particular printhead, including the time of each failure occurrence and the time between subsequent failures, also known as the inter-arrival time.

TABLE 1

| Number of Nozzle Outs | Failure Time (Ti) | Inter-Arrival Time (Xi) |
|---|---|---|
| 1 | 260 | 260 |
| 2 | 400 | 140 |
| 3 | 1250 | 850 |
| . . . | . . . | |
| n | 2000 | |

Let Ti represent the arrival time for the $i^{th}$ failure and Xi represent the time between (i−1) and the ith failure. An estimate of the rate at which failures are occurring is a useful means of predicting future failures. The inter-arrival times between failures are not considered independent nor identically distributed because the failures themselves may be dependent upon each other and are thought to occur randomly, as mentioned above. Because the failures are dependent upon one another, the inter-arrival times between failures may follow trends based upon the failure dependencies.

To account for this complex relationship, a stochastic point process model, may be utilized. Stochastic processes, also known as random processes, relate to sequences of events constrained by probability. A stochastic point process is a stochastic process that is realized by a series of discrete data instead of a continuous path. One type of stochastic point process that yields a distribution of intervals between changes in data points that are not independent and are not independently distributed is a non-homogeneous Poisson process. Because the inter-arrival times between nozzle failures cannot be considered independent nor identically distributed, a non-homogeneous Poisson process is a suitable process model for the instant application. The following are some of the more important relationships of the distribution.

The rate of failure occurrence may be described as $v(t)=\lambda\beta^{\beta-1}$, where the change in v(t) over an interval (v(t)dt) represents the probability that a failure will occur in the interval (t, t+dt).

If N(t) is used to denote the number of failures that have occurred at t, then the probability that a system, such as a printhead, will experience j failures in the interval ($t_1$, t2) is given by the Poisson expression:

$$\text{Prob}\,[N(t_2-t_1)=j]=\frac{\left[\int_1^2 v(t)\,dt\right]^j e^{\left(-\int_{t1}^{t2} v(t)dt\right)}}{j!} \qquad \text{(Equation A)}$$

For the purposes of these teachings it is important to calculate the expected number of failures E during the interval ($t_1$, $t_2$). This is derived from Equation A above, and represented by:

$$E[N(t_2)-N(t_1)] = \int_1^2 \nu(t)\,dt = \lambda(t_2)^\beta - \lambda(t_1)^\beta \qquad \text{(Equation B)}$$

If, for a given incoming print job, this predicted number of failures plus the number of nozzles out at the beginning of the print job exceeds the maximum number of nozzles out, beyond which image quality cannot be assured, then the user may be notified that the proper image quality cannot be assured.

The parameters $\lambda$ and $\beta$ are obtained from nozzle failure data gathered over time by applying Crow maximum likelihood estimators to the interarrival times, assuming that a single system at the time of its $m^{th}$ failure may be represented as:

$$\hat{\beta} = \frac{m}{\sum_{i=1}^{m-1} \ln\left(\frac{T_m}{T_i}\right)} \text{ and } \hat{\lambda} = \frac{m}{T_m^{\hat{\beta}}}$$

Maximum likelihood estimation is used to find the population that is most likely to produce the observed sample. Crow maximum likelihood estimators are specific types of estimators defined by the equations above.

Because the failure data over time is collected for more than one system, a set of parameters ($\lambda$, $\beta$) is obtained for each printhead each time there is a nozzle out. These parameters belong to a distribution of mean $\bar{\lambda}$ and standard deviation $\sigma_\lambda$, and mean $\bar{\beta}$ and standard deviation $\sigma_\beta$, respectively.

An example analysis begins with the data shown in Table 2 where the maximum number of nozzles out is 4 and three printheads are analyzed.

TABLE 2

| Cc's for given nozzle out | Printhead 1 | Printhead 2 | Printhead 3 | Mean | Standard Deviation |
|---|---|---|---|---|---|
| Nozzle outs = 1 | 130 | 150 | 200 | 160 | 36 |
| Nozzle outs = 2 | 450 | 600 | 500 | 517 | 76 |
| Nozzle outs = 3 | 1500 | 800 | 1000 | 1100 | 361 |
| Nozzle outs = 4 | 1600 | 1500 | 1300 | 1467 | 153 |

Using the equations above, $\hat{\lambda}$ and $\hat{\beta}$ are calculated where m=number of nozzles out, in this example 4, $T_m$=cc's when the number of nozzles out is 4, and $T_i$=cc's when the number of nozzles out is 1. The mean and standard deviation of $\hat{\lambda}$ ($\bar{\lambda}$, $\sigma_\lambda$) and $\hat{\beta}$ ($\bar{\beta}$, $\sigma_\beta$) are also calculated.

TABLE 3

| | Printhead 1 | Printhead 2 | Printhead 3 | $\bar{\lambda}$, $\sigma_\lambda$ | $\bar{\beta}$, $\sigma_\beta$ |
|---|---|---|---|---|---|
| $\hat{\lambda}$ | 1.0407 | 1.03964 | 1.2946 | (1.12, 0.14) | — |
| $\hat{\beta}$ | 0.00185 | 0.001996 | 0.000372 | — | (0.0014, 0.00089) |

When a new printhead is installed in the printer, ideally there are no failures, that is, no nozzle outs, and the expected number of failures is the number of nozzles out at the beginning of the print job. Once the printhead has experienced a nozzle out, the set of parameters ($\lambda$,$\beta$) may be calculated from the relationship: $\lambda=\bar{\lambda}+k\sigma_\lambda$ and $\beta=\bar{\beta}+k\sigma_\beta$ for the printhead, where K=(cc's for number of nozzles out—mean cc's for number of nozzles out)/standard deviation for number of nozzles out (from Table 2).

As an example, for a new printhead installed in the system described by Tables 2 and 3 above, if the cc's for a first nozzle out is 170, then K=(170−160)/36=0.27.

The parameters ($\lambda$,$\beta$) may then be determined.

$$\begin{aligned}(\lambda, \beta) &= (\bar{\lambda} + k\sigma_\lambda, \bar{\beta} + k\sigma_\beta)\\ &= ((1.12 + 0.27 * 0.14), (0.0014 + 0.27 * 0.00089))\\ &= (1.157, 0.0164)\end{aligned}$$

Upon the occurrence of each subsequent nozzle out, the parameters ($\lambda$,$\beta$) are recalculated in order to update the probability of failure.

At the beginning of each print job, the updated parameters ($\lambda$,$\beta$) are plugged into Equation B above, where $t_1$ is the volume of ink expelled by the printhead thus far, and $t_2$ is $t_1$ plus the volume of ink for the incoming print job determined from the print job's ink flux. This predicted number of failures from Equation B plus the number of nozzles out at the beginning of the print job are compared to the maximum number of nozzles out, beyond which image quality cannot be assured. If the predicted number of failures plus the number of nozzles out at the beginning of the print job exceed the maximum number of nozzles out, then the operator or user may be alerted that the proper image quality cannot be assured.

Figure 7:
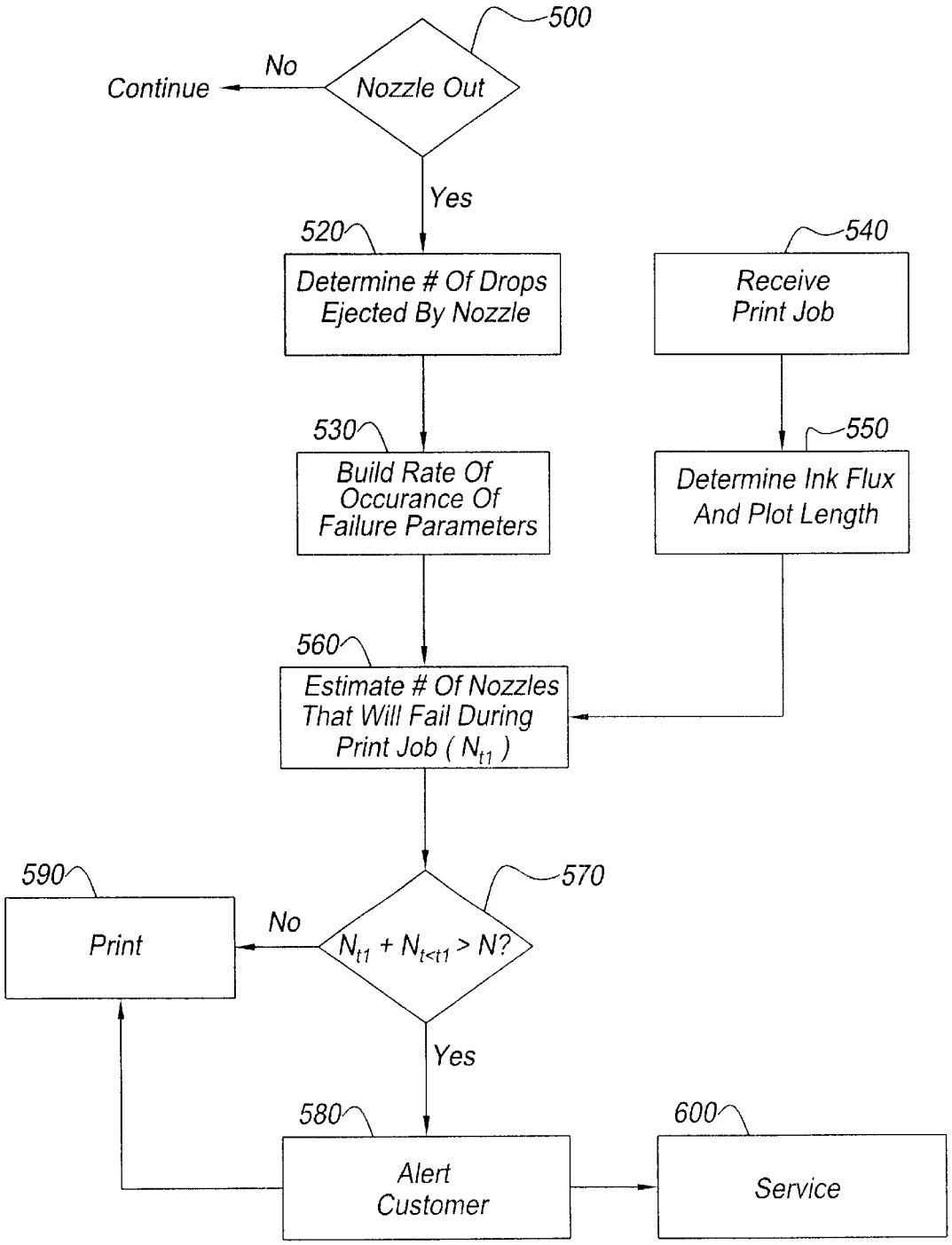
FIG. 7 shows a flow diagram of the operation of a printer in accordance with the teachings of this invention.

A method of utilizing the techniques described above in conjunction with an incoming print job is described with reference to FIG. 7.

In step 500, at some time during normal operations, the printer 20 executes a series of procedures to determine if any nozzles are out for a particular printhead. If the printer determines that no nozzles are out, normal printing operations continue as in step 510. In the event that a nozzle is out, the number of droplets ejected by the nozzle are determined in step 520. In step 530, the rate of occurrence of the failure (as shown in Table 2) and the parameters ($\lambda$,$\beta$) are determined.

Upon receiving a print job, step 540, the ink flux for each color and the plot length are calculated as shown in step 550. The number of nozzles that are going to fail during the print job are then estimated utilizing Equation B, the ink flux, and the plot length of the print job (step 560). In step 570, the estimated number of nozzles that are going to fail ($n_{t1}$) is added to the actual number of nozzles currently "out" ($n_{t1}+n_{t<t1}$) and compared to the maximum number of nozzles out that can be permitted for a given image quality (N). If the maximum number of nozzles out will be exceeded during the plot, the user is alerted as shown in step 580. The user may optionally permit printing, or may initiate a service routine (step 600). In the event that the maximum number of nozzles out will not be exceed, the print job is plotted in step 590.

It can thus be appreciated that while the invention has been particularly shown and described with respect to preferred embodiments thereof, it will be understood by those skilled in the art that changes in form and details may be made therein without departing from the scope and spirit of the invention.

We claim:

1. A method of printing a print job comprising:

determining which nozzles of a printhead are currently failing;

estimating a number of additional printhead nozzles that will fail while printing said print job;

calculating a maximum number of failing nozzles that may not be exceeded in order to maintain a specified quality level for said print job; and determining if said number of currently failing printhead nozzles added to said estimated number of additional printhead nozzles that will fail exceeds said calculated maximum number of failing nozzles.

2. The method of claim 1, further comprising providing a notification in the event that said number of currently failing printhead nozzles added to said estimated number of additional printhead nozzles that will fail exceeds said calculated maximum number of failing nozzles.

3. The method of claim 1, wherein determining which nozzles of a printhead are currently failing comprises determining the health of the printhead nozzles.

4. The method of claim 1, wherein estimating a number of additional printhead nozzles that will fail comprises utilizing a stochastic point process model.

5. The method of claim 4, wherein said stochastic point process model comprises a non-homogeneous Poisson process.

6. The method of claim 1, wherein estimating a number of additional printhead nozzles that will fail comprises utilizing the ink flux and print length of said print job in combination with a stochastic point process model.

7. A printer for printing a print job comprising:

an ink drop detector for determining which nozzles of a printhead are currently failing;

a processor for estimating a number of additional printhead nozzles that will fail while printing said print job;

first circuitry for calculating a maximum number of failing nozzles that may not be exceeded in order to maintain a specified quality level for said print job; and second circuitry for determining if said number of currently failing printhead nozzles added to said estimated number of additional printhead nozzles that will fail exceeds said calculated maximum number of failing nozzles.

8. The printer of claim 7, further comprising circuitry for providing a notification in the event that said number of currently failing printhead nozzles added to said estimated number of additional printhead nozzles that will fail exceeds said calculated maximum number of failing nozzles.

9. The printer of claim 7, wherein said ink drop detection circuitry determines the health of the printhead nozzles.

10. The printer of claim 7, wherein said processor estimates a number of additional printhead nozzles that will fail utilizing a stochastic point process model.

11. The printer of claim 10, wherein said stochastic point process model comprises a non-homogeneous Poisson process.

12. The printer of claim 7, wherein said processor estimates a number of additional printhead nozzles that will fail utilizing the ink flux and print length of said print job in combination with a stochastic point process model.

13. A printer comprising:

A printer including a processor that performs the following operations:

determining which nozzles of a printhead are currently failing;

estimating a number of additional printhead nozzles that will fail while printing said print job;

calculating a maximum number of failing nozzles that may not be exceeded in order to maintain a specified quality level for said print job; and determining if said number of currently failing printhead nozzles added to said estimated number of additional printhead nozzles that will fail exceeds said calculated maximum number of failing nozzles.

14. The printer of claim 13, wherein said operations further comprise:

providing a notification in the event that said number of currently failing printhead nozzles added to said estimated number of additional printhead nozzles that will fail exceeds said calculated maximum number of failing nozzles.

15. The printer of claim 13, wherein said operations further comprise:

determining which nozzles of a printhead are currently failing comprises determining the health of the printhead nozzles.

16. The printer of claim 13, wherein the operation of estimating a number of additional printhead nozzles that will fail comprises utilizing a stochastic point process model.

17. The printer of claim 16, wherein said stochastic point process model comprises a non-homogeneous Poisson process.

18. The printer of claim 13, wherein the operation of estimating a number of additional printhead nozzles that will fail comprises utilizing the ink flux and print length of said print job in combination with a stochastic point process model.

* * * * *